US008979778B2

(12) United States Patent
Faredoun

(10) Patent No.: US 8,979,778 B2
(45) Date of Patent: Mar. 17, 2015

(54) WATER TREATMENT DEVICE

(76) Inventor: Muna H. S. A. Faredoun, Dasman (KW)

( * ) Notice: Subject to any disclaimer, the term of this patent is extended or adjusted under 35 U.S.C. 154(b) by 615 days.

(21) Appl. No.: 13/315,472

(22) Filed: Dec. 9, 2011

(65) Prior Publication Data

US 2013/0150757 A1 Jun. 13, 2013

(51) Int. Cl.

| | |
|---|---|
| ***A61H 1/00*** | (2006.01) |
| ***A61H 1/02*** | (2006.01) |
| ***A61H 33/00*** | (2006.01) |
| ***B05B 1/18*** | (2006.01) |
| ***B05B 1/24*** | (2006.01) |

(52) U.S. Cl.

CPC ..... *A61H 33/0095* (2013.01); *A61H 33/6036* (2013.01); *A61H 2201/5035* (2013.01); *A61H 2205/022* (2013.01); *A61H 2205/04* (2013.01); *B05B 1/18* (2013.01); *B05B 1/24* (2013.01)

USPC ..... 601/17; 4/615

(58) Field of Classification Search

USPC ..... 601/16, 17, 154–156, 160–163, 601/165–166, 169; 4/596, 601, 612, 615, 4/567–570

See application file for complete search history.

(56) References Cited

U.S. PATENT DOCUMENTS

| | | | | |
|---|---|---|---|---|
| 2,023,412 | A * | 12/1935 | Dobbyn | 601/17 |
| 3,712,307 | A | 1/1973 | McLaughlin | |
| 3,768,483 | A | 10/1973 | Kusunoki | |
| 4,621,641 | A | 11/1986 | Frank et al. | |
| 5,094,237 | A | 3/1992 | Peters | |
| 6,168,574 | B1 * | 1/2001 | VanDemark | 601/155 |
| 6,227,456 | B1 * | 5/2001 | Colman | 239/1 |
| 6,412,125 | B1 * | 7/2002 | Ito et al. | 4/615 |
| 7,168,108 | B2 * | 1/2007 | Guerin et al. | 4/596 |

OTHER PUBLICATIONS

Cade, Matteson. "How to Moisturize Your Face" Aug. 20, 2009. HowStuffWorks.com. <http://health.howstuffworks.com/skin-care/moisturizing/basics/moisturize-face.htm> Jul. 7, 2014.*

Secrets of Longevity: "One of the best kept antiaging secrets is how cold showers can keep your skin glowing and radiant looking". https://web.archive.org/web/20100502050021/http://www.secrets-of-longevity-in-humans.com/cold-showers.html. Accessed Jun. 24, 2014.*

YahooAnswers. "What if you have swollen feet and ankles?". https://answers.yahoo.com/question/index?qid=20070901083344AAAIIxF. Accessed Jun. 24, 2014.*

* cited by examiner

*Primary Examiner* — Justine Yu
*Assistant Examiner* — Kathrynn Reilly
(74) *Attorney, Agent, or Firm* — Lowe Hauptman & Ham, LLP

(57) ABSTRACT

A hand held movable water treatment device for tightening and whitening facial and neck skin by directing multiple streams of pressurized hot and cold water onto selected parts of an individual's face and neck, including a generally circular support member having a flat surface on a first side thereof, a handle extending from a peripheral edge of the generally circular support member, a flexible hose having a first end and a second, and a tubular member concentrically disposed on the flat surface of the generally circular support member.

3 Claims, 3 Drawing Sheets

WATER TREATMENT DEVICE

FIELD OF THE INVENTION

This invention relates to a water treatment device and more particularly to a handheld movable water treating device for tightening and whitening facial and neck skin by directing multiple streams of pressurized and heated water onto selected parts of an individuals face and neck and to methods for treating facial and neck skin.

BACKGROUND OF THE INVENTION

Facial treatment devices are well known and have been in widespread use for many years. For example, a facial sauna is disclosed in a U.S. Pat. No. 3,768,483 of Kusunoki. As disclosed a facial sauna device for face treatment with hot steam and beauty liquid nutritious to skin which comprises a nozzle of steam generating means and a hood having an opening receiving a user's face and arranged to surround the nozzle. The hood is provided with a spherical concave surface partly on its inner surface so that the steam is sprayed out of the nozzle toward the face receiving opening. The hood is detachably mounted to a saucer-shaped receptacle provided on an upper part thereof to the steam generating means. The device also includes a breathing duct of a horn shape detachably mounted to a duct receiving means provided in the hood and communicating the duct with external air. The hood preferably comprises a fixed hood member detachably mounted to the saucer-shaped receptacle and a movable hood member rotatably mounted to the fixed member.

A more recent U.S. patent of Carminucci U.S. Pat. No. 5,938,693 that discloses a Moist Heat In Vapor Form Health And Beauty Therapeutic System. The patent discloses a therapeutic system comprising a generator for generating moist heat in vapor form. The generator comprises a housing having a vapor chamber and a fluid reservoir. The fluid reservoir receives a fluid to be vaporized. The housing further contains a heater for heating the fluid received in the fluid reservoir in a first controlled manner to produce the moist heat in vapor form wherein the moist heat in vapor form produced is contained in the vapor chamber. An interface remote from the generator interfaces the moist heat in vapor form with a desired treatment area. A delivery mechanism connected between the generator and the interface delivers the moist heat in vapor form from the generator to the interface in a second controlled manner. Lastly, a controller connected with the generator and the delivery mechanism controls the heating of the fluid received in the fluid reservoir in the first controlled manner and further controls the delivery of moist heat in vapor form to the treatment area in the second manner. The generator further provides for the inclusion of a treatment additive to the moist heat in vapor form.

Finally, a Facial Treatment Device is disclosed in a U.S. Pat. No. 6,679,908 of Shimizu. The Shimizu patent discloses a facial treatment device which can repeat warming and cooling of the face of a person while massages are given to the face at the same time whereby the beauty effects such as the facial treatment and body slimming can be mutually and efficiently obtained. A Peltier element is placed adjacent to a probe having a high thermal conductivity which can abut the face of a person to be treated. Then the current is supplied by a DC power supply to the Peltier element and the direction of the current can be switched between the forward and backward directions by a selector switch. Thereby the cooling and warming of the probe 11 is repeated. At the same time a motor

15 having an eccentric weight 17 is attached thereto and is driven whereby the probe is vibrated.

Notwithstanding the above, it is presently believed that there is a need and a potential commercial market for an improved water treatment device in accordance with the present invention. There should be a need for and potential commercial market for such devices because they facilitate treating the face and neck of an individual with multiple fine streams of pressurized and heated water. Further, the devices are of rugged construction, durable, essentially maintenance free and can be manufactured and sold at a relatively low cost.

BRIEF SUMMARY OF THE INVENTION

In essence, the present invention contemplates a hand held water treatment device for tightening and whitening the facial and neck skin of an individual. The water treatment device comprises or consist of a generally circular support member and a concentric partially circular tubular element fixed to the support member and wherein each of the two tubular elements or ring like elements include a plurality of nozzles and where each of the nozzles includes a plurality of outwardly directed fine openings for directing fine streams of pressurized heated water onto selected areas of facial and neck skin. A source of water under pressure and means for increasing and decreasing the pressure of the water as well as means for controlling the temperature of the water are provided. In a preferred embodiment of the invention a flexible one-half inch ID hose connects the tubular element or elements to the source of water.

The present invention also contemplates a method for treating facial and neck skin with pressurized and heated water to tighten and whiten the skin. The method comprises and/or consists of the following steps: providing a flat generally circular support member and a tubular element in the form of two concentric circles. The circles include an inner circular of about six inch diameter and an outer circle of about seven inches diameter. Each of the two concentric circles contain between four and six outwardly directed nozzles and wherein each of the nozzles include between four and six fine openings of about one mm diameter for directing a plurality of fine streams onto selected portions of the face and/or neck of an individual. Those areas of the face and neck are subjected to a circular motion of the fine sprays for periods of two up to about five minutes and preferably of about three minutes.

The invention will now be described in connection with the accompanying drawings wherein like elements have been identified with like numbers.

DESCRIPTION OF THE PREFERRED EMBODIMENT OF THE INVENTION

Figure 1:
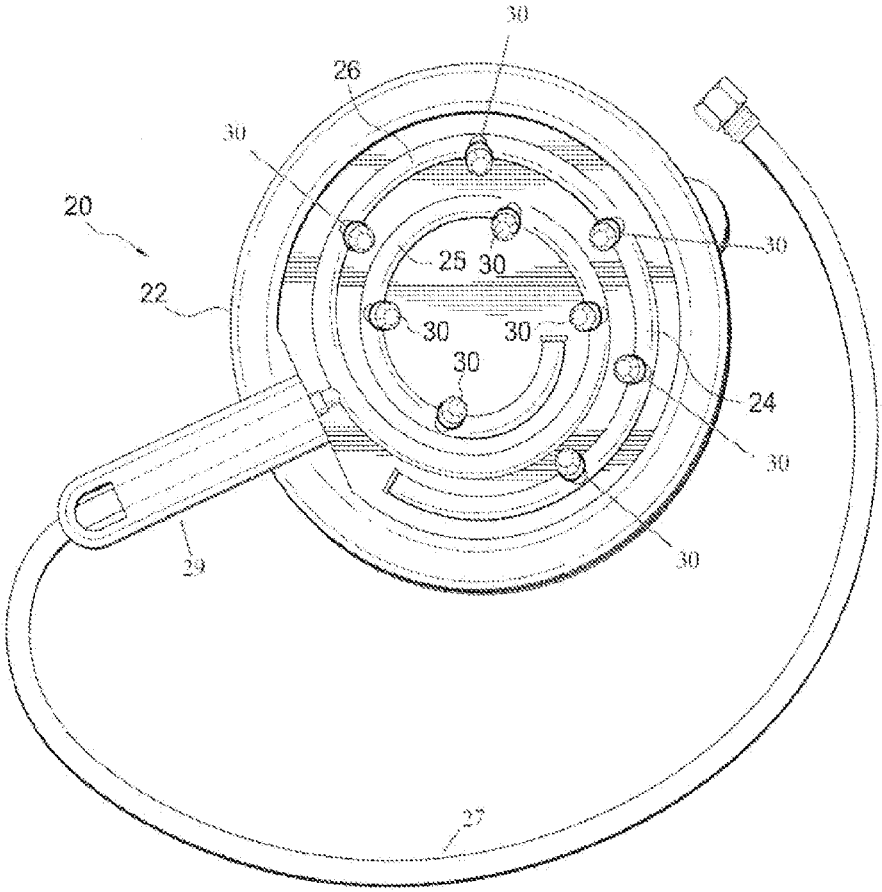
FIG. 1 is a schematic view of a portion of a device in accordance with the invention.

As shown in FIG. 1, a hand held water treating device 20 for tightening and whitening the facial and neck skin of an individual includes a flat generally circular support member 22 and a tubular element 24 fixed to the support member 22. The tubular element 24 is in the form of two concentric connected rings or circles 25 and 26 with the outer ring or circle 26 having an outer diameter of about 160 to 200 mm while the inner ring or circle has an outer diameter of about 100 to 120 mm. The tubular element 24 has an inside diameter of about one-half inch or 10 to 15 mm. The hand held water treating device 20 further includes a flexible hose 27, and a handle 29 extending outwardly from the support member 22.

As illustrated in FIG. 1, the support member 22 maybe made of a suitable rigid plastic as for example, polyvinyl chloride or other plastic material, stainless steel or chrome plated metal while the tubular element 24 and nozzles 30 may be of plastic or metal. Plastic such as polyvinyl chloride is preferred material for light weight and resistance to rust.

In a first preferred embodiment of the invention the inner ring or circle 25 has four approximately equally spaced nozzles 30. As shown each of the nozzles 30 includes 4 to 6 outwardly directed small openings of about 1 mm diameter for directing a fine stream of heated or cold pressurized water onto the facial or neck skin of an individual.

A control means such as a hot or cold outlet is provided to adjust the pressure and temperature of the fine streams of water. In a preferred embodiment of the invention the device 20 may have a separate pressure control mechanism 32 and heater for heating the water to a temperature of between about 22° C. and 26° C. and a pressure control to reduce the pressure to low, medium and high wherein the low is very soft application of water and the high may slightly sting the face.

Figure 2:
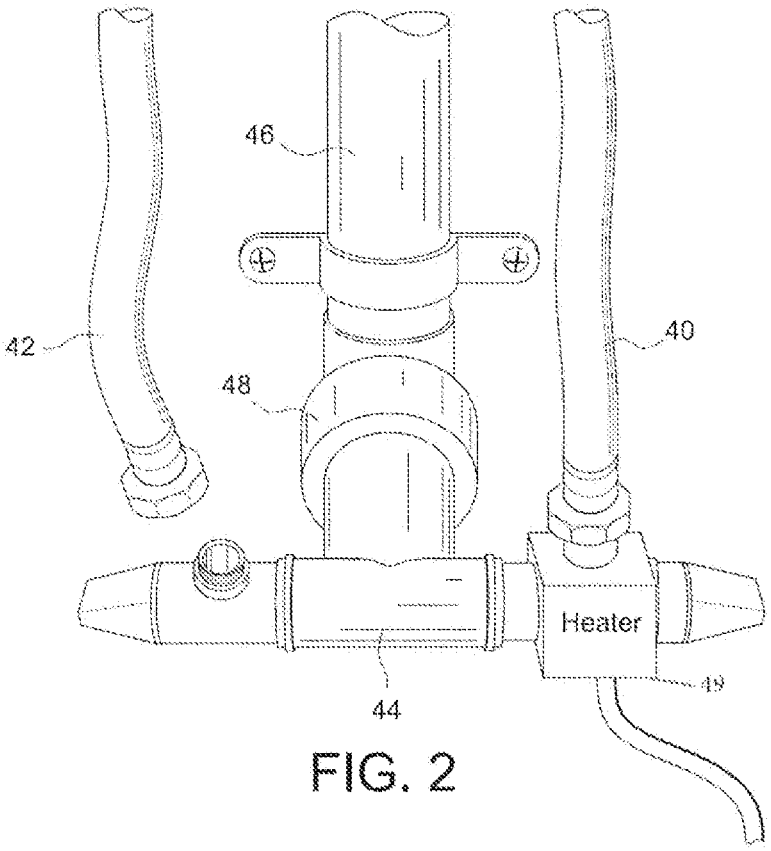
FIG. 2 is a perspective view of a manifold for mixing cold and hot water for use in practicing the invention.

As shown in FIG. 2, a hot water inlet 40 and cold water inlet 42 direct hot and cold water into a manifold 44 when the temperature of the water and pressure of the water are adjusted in a conventional manner and an outward flow is directed to the nozzles 30 by an outlet tube 46. A pressure regulator 48 is shown schematically and can be of any conventional design. A heater 49 is also shown schematically as being adjacent the manifold. However in practice hot water is delivered through the tube 48 from a conventional water heater (not shown).

Figure 3:
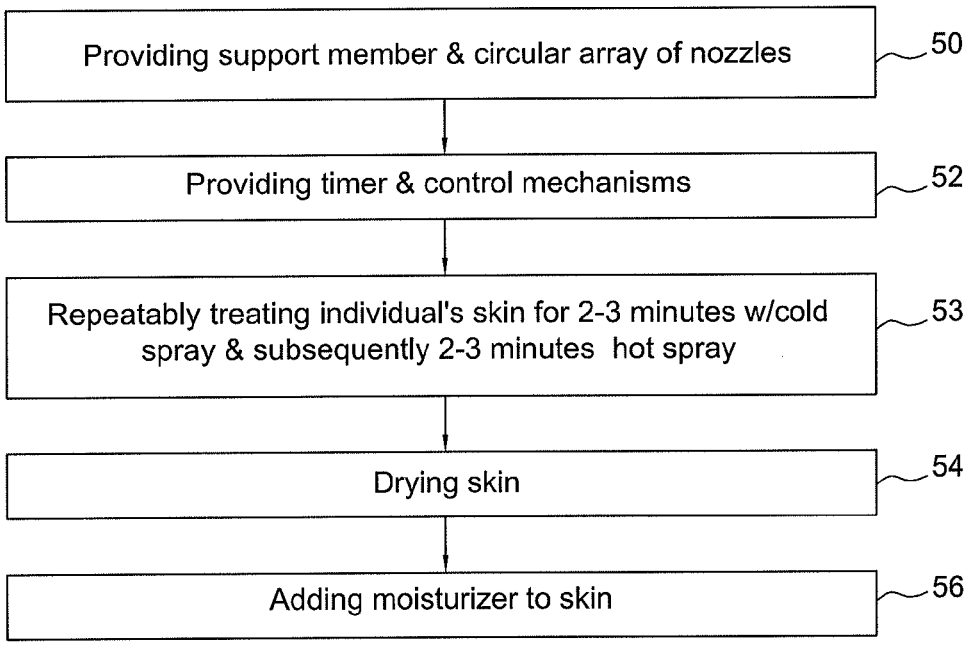
FIG. 3 is a flowchart that illustrates a method in accordance with a second embodiment of the invention.

The invention also contemplates a method for treating facial and neck skin with multiple fine sprays of water at different temperatures and different pressures to tighten the facial and neck skin. The method comprises and/or consists of the steps of providing a hand held water treatment device 20. The device 20 includes a support member 22 of a flat generally circular support member 22 with a tubular element defining two concentric circles 25 and 26 disposed on the support member 22. In FIG. 3, the device 30 also includes a timer 23 and a mechanism for alternately providing hot and cold water in a plurality of fine sprays to preselected areas of the face and neck for a preselected period of time.

For example, moderate heated water may be directed at selected areas of the face or neck for up to 2-5 minutes followed by moderately cold water for a like period of time. It is also contemplated that shorter time periods and multiple cycles can be used.

The mechanism for providing alternate treatments of hot and cold water may incorporate a computer controlled series of valves for alternately opening and closing a hot water and cold water tap or for mechanically controlling the temperature of hot and cold water. An alternative mechanism may include a Peltier element wherein the direction of the current can be switched to heat or cool the water as disclosed in the aforementioned U.S. Pat. No. 6,679,908 of Shimizu. That patent is incorporated herein in its entirety by reference.

A further approach to a method in accordance with the present invention incorporates a temperature selectable water supply device as disclosed in the U.S. patent of Al-Khateeb U.S. Pat. No. 6,213,199. The Al-Khateeb patent is incorporated herein in its entirety by reference. The patent discloses a temperature selectable water supply device for one of heating and cooling water provided by a water supply system to an outlet in a structure. The device includes a main water tank including an inlet conduit for receiving water from a water supply tank connected to the water supply and an outlet conduit for supplying water to the outlet connected thereto. The temperature selectable water supply device also includes a water refrigeration unit connected to receive water from the main water supply tank for cooling to a desired temperature. A heating device is connected to the main water supply tank for heating the water therein and a cooling device is connected to the water refrigeration tank for cooling the water received therefrom. A return conduit is connected between the water configuration tank and the main water tank for returning the cooled water to the main water tank for mixing with the water therein and thereby cooling the water. A hot water thermostat is connected to the main water tank for measuring a temperature of the water therein and activating the heating device to heat the water when the measured temperature is below a first predetermined adjustable value. A cold water thermostat is connected to the cooling cycle for measuring a temperature of the water within the main water supply tank and activating the cooling device when the measured temperature is above a second predetermined adjustable value.

In one preferred embodiment of the invention a method for treating an individual's facial and neck skin includes a step 50 of providing a circular support portion including an inner and outer concentric arrays of nozzles connected by a tubular element the method also includes a step of providing a support member and two concentric circular arrays of nozzles connected by a tubular element 51. The method also includes a step 52 of providing a timer and control mechanism for controlling temperature, water pressure and a mechanism for controlling the time for alternately hot and cold treatments while automatically changing from hot to cold water temperature for a preselected number of times in step 53. After this the skin is dried in step 54 and moisturizer added to the skin in step 56.

While the invention has been described in connection with its preferred embodiments it should be recognized that changes and modifications may be made therein without departing from the scope of the appended claims.

What is claimed is:

1. A hand held movable water treatment device for tightening and whitening facial and neck skin by directing multiple streams of pressurized hot and cold water onto selected parts of an individual's face and neck, said hand held movable device comprising:

a generally circular support member having a flat surface on a first side thereof;

a handle extending from a peripheral edge of said generally circular support member;

a flexible hose having a first end and a second end;

a tubular member concentrically disposed on said flat surface of said generally circular support member, said tubular member having a first closed end, a second closed end, and an inlet on an outer surface thereof, wherein said inlet is removably connected to said second end of said flexible hose;

a plurality of nozzles disposed on and extending outwardly from said tubular member, wherein each of said plurality of nozzles includes a plurality apertures for directing fine sprays of heated pressurized streams of water and cold pressurized streams of water onto selected parts of an individual's face and neck;

a source of water under pressure, a water heater for heating the pressurized water and a flexible one-half inch hose connecting the pressurized heated water to each of said tubular elements and a valve disposed between said source of pressurized heated water and said tubular element for controlling pressure and for connecting and disconnecting said source of pressurized hot and cold water to and from said tubular elements.

2. The hand held movable water treatment of claim 1, wherein said plurality of nozzles comprises 4 to 6 nozzles and said plurality of apertures comprises 4 to 6 apertures.

3. The hand held movable water treatment of claim 2 that includes flow control means for controlling the water pressure and means for controlling the temperature of the water passing through said apertures.

* * * * *